United States Patent [19]

Antonious

[11] 4,079,527

[45] Mar. 21, 1978

[54] SHOE

[76] Inventor: Anthony J. Antonious, 7005 Lachan Cir., Baltimore, Md. 21239

[21] Appl. No.: 829,373

[22] Filed: Aug. 31, 1977

Related U.S. Application Data

[63] Continuation of Ser. No. 692,406, Jun. 3, 1976, abandoned.

[51] Int. Cl.[2] ..... A43B 11/00

[52] U.S. Cl. ..... 36/51

[58] Field of Search ..... 36/50, 51

[56] References Cited

U.S. PATENT DOCUMENTS

| | | | |
|---|---|---|---|
| 913,012 | 2/1909 | Jackson | 36/51 |
| 2,082,537 | 6/1937 | Butler | 36/51 X |
| 3,009,221 | 11/1961 | Firari | 36/50 X |
| 3,037,303 | 6/1962 | Steuer | 36/51 |
| 3,626,610 | 12/1971 | Dassler | 36/50 |

FOREIGN PATENT DOCUMENTS

| | | | |
|---|---|---|---|
| 935,640 | 10/1973 | Canada | 36/50 |
| 381,816 | 11/1970 | France | 36/51 |
| 430,494 | 8/1967 | Switzerland | 22/DIG. 6 |
| 220,141 | 8/1924 | United Kingdom | 36/51 |
| 1,043,723 | 9/1966 | United Kingdom | 36/50 |

*Primary Examiner*—Alfred R. Guest

*Attorney, Agent, or Firm*—Sughrue, Rothwell, Mion, Zinn and Macpeak

[57] ABSTRACT

Disclosed is a shoe which utilizes a flap, tab, strap, or straps attached to one or both sides of the shoe to maintain a direct constant tautness with independent control of tautness across the toes, arch and ankle. The flap, tab(s), strap, or straps have a flexible and continuously variable attachment means at the free end and include yielding elastic means.

3 Claims, 12 Drawing Figures

FIG.1
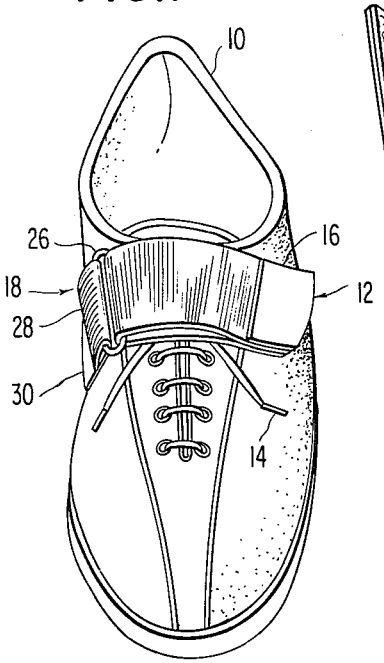
FIG.2
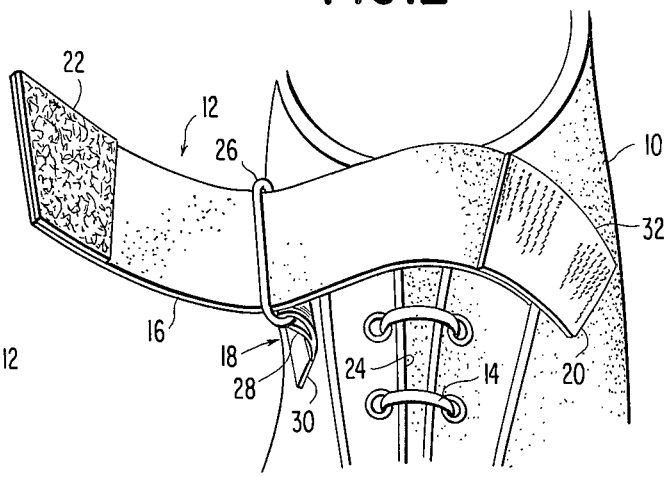
FIG.3
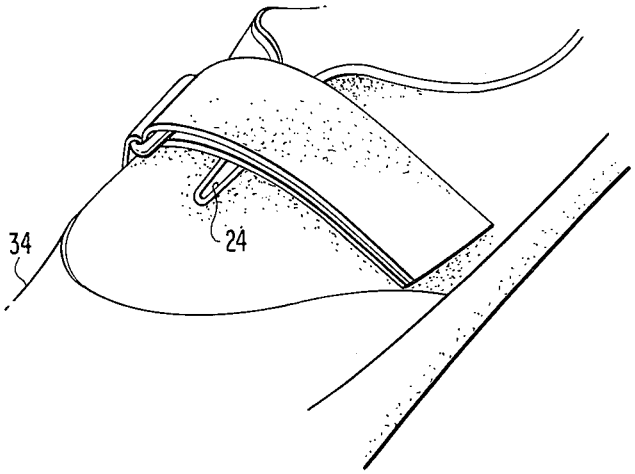
FIG.4
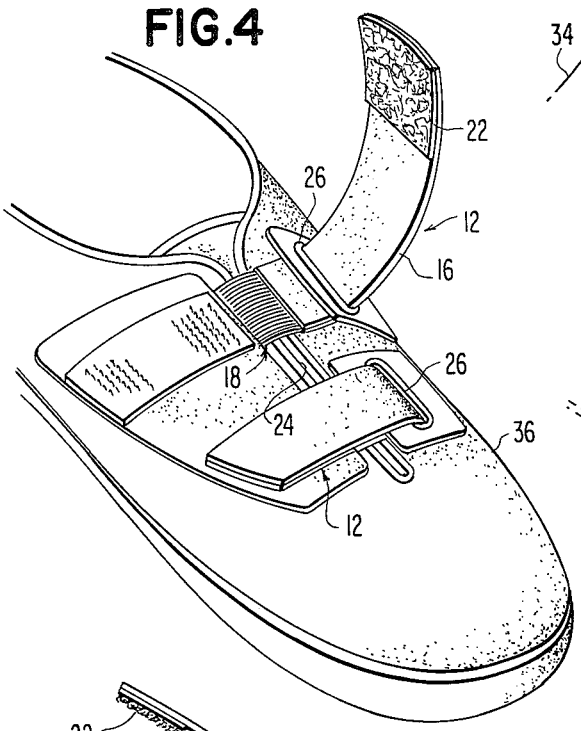
FIG.5
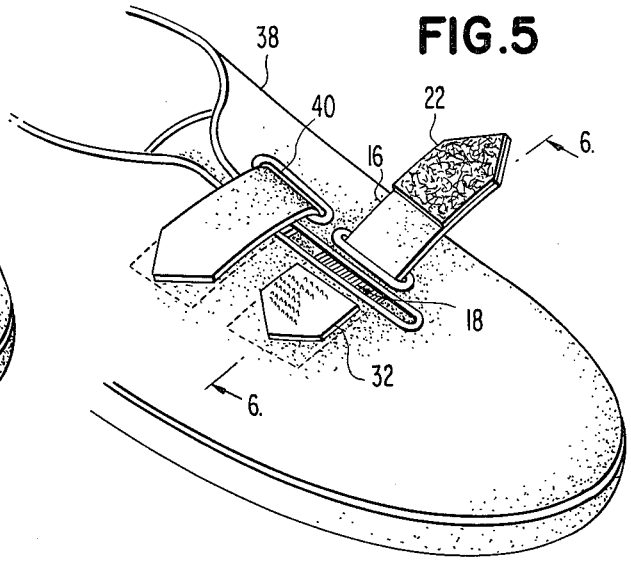
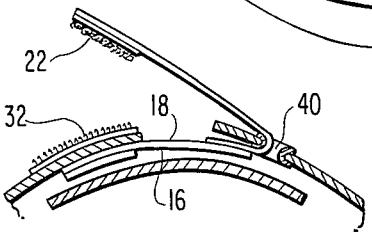
FIG.6

FIG.7
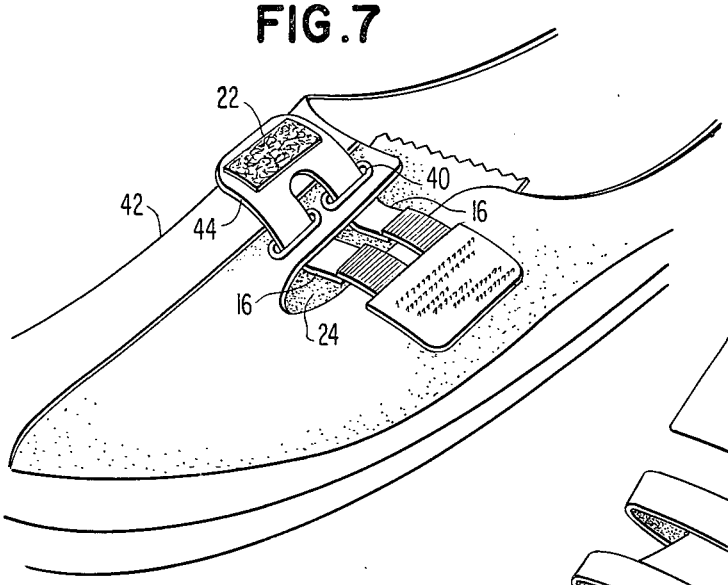
FIG.8
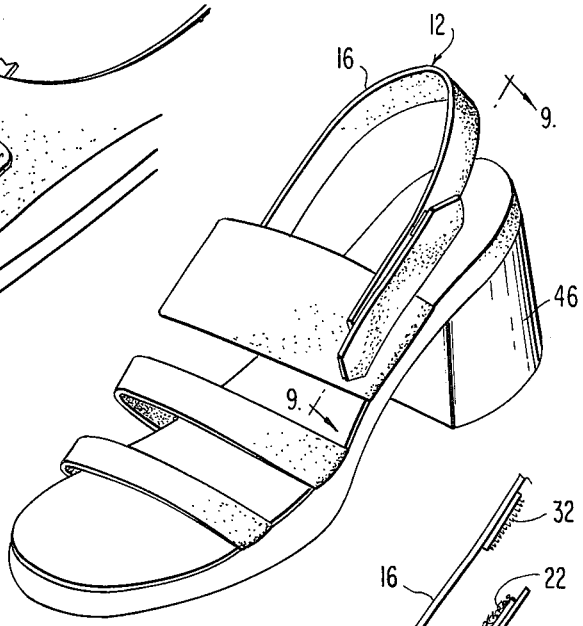
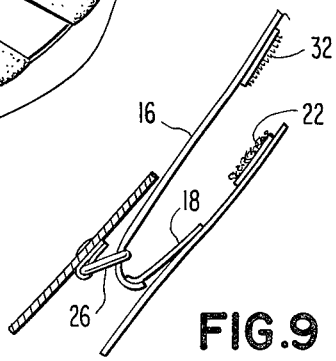
FIG.9
FIG.12
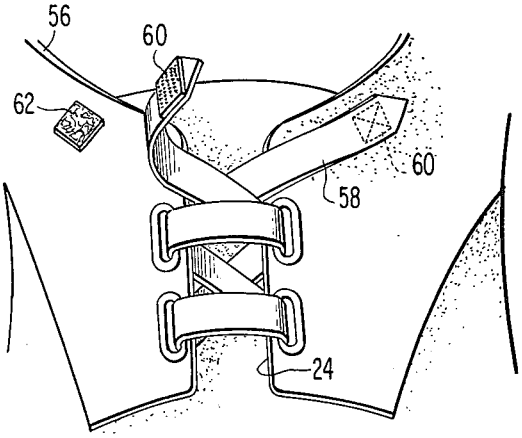
FIG.10
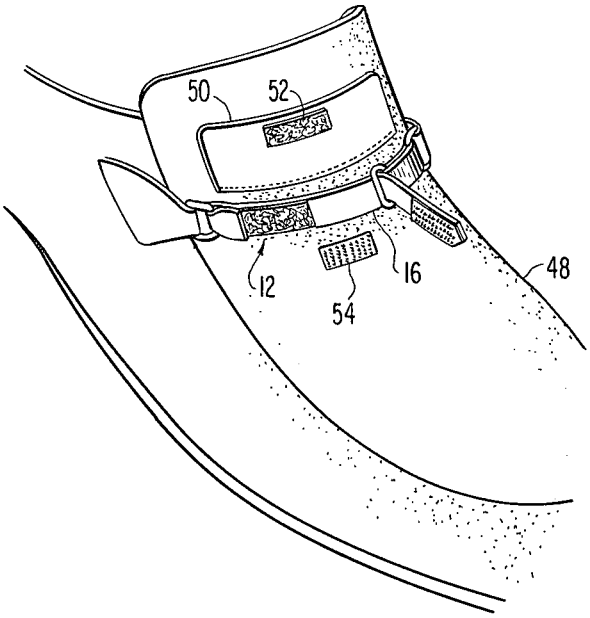
FIG.11
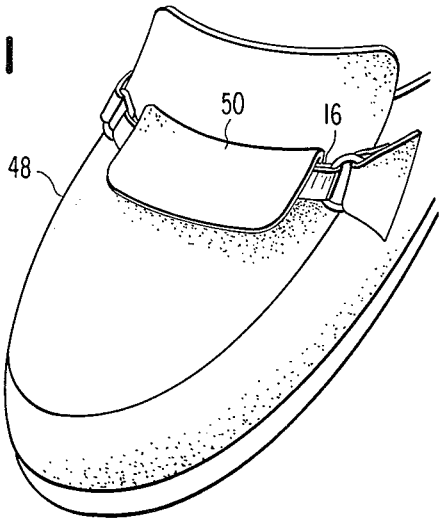

SHOE

This is a continuation of application Ser. No. 692,406, filed June 3, 1976, now abandoned.

FIELD OF THE INVENTION

This invention relates to shoes. It is particularly, but not exclusively, suited for use in shoes designed for use in various athletic endeavors, such as tennis shoes, basketball shoes, golf shoes, etc. It is also suited for work shoes, dress shoes, boots, overshoes, and other footwear.

BACKGROUND OF THE INVENTION

This invention relates to improvements in shoes which can eliminate the use of laces which only provide a fixed tautness, buckles and other rigid fasteners which provide a limited, fixed, or precise position for fastening the shoe to the wearer's foot. To provide the most comfortable and proper fitting of shoes, it is necessary to retie laces when they become loose from constant flexing of the foot while wearing a shoe or when a lace becomes untied. Use of buckles offers only limited tautness as provided by the fixed spacing of the eyelets for insertion of the rigid metal stud/latch on a buckle. For such fastening means, the use of both hands is required. Broken or loosely tied laces can cause the wearer great discomfort or injury, especially if engaged in a vigorous, quick-action sport such as basketball, tennis, track, baseball, football, golf, and the like where considerable force is exerted to the fastening means of the shoe.

SUMMARY OF THE INVENTION

Shoes according to the subject invention have one or more improved fastening means comprising (1) a strap fixedly attached to the body of the shoe at one end thereof and having a Velcro-type, continuously variable attachment means at the other end and (2) an elastic means for exerting a yielding pull on the strap to maintain tautness in the strap during use of the shoe.

BRIEF DESCRIPTION OF THE DRAWINGS

FIG. 1 is a perspective view of a first embodiment of the subject invention.

FIG. 2 is an enlarged perspective view of a detail of the embodiment shown in FIG. 1.

FIG. 3 is an enlarged perspective view of a detail of a second embodiment of the subject invention.

FIG. 4 is a perspective view of a third embodiment of the subject invention.

FIG. 5 is a perspective view of a fourth embodiment of the subject invention.

FIG. 6 is a view along the 6—6 in FIG. 5.

FIG. 7 is a perspective view of a fifth embodiment of the subject invention.

FIG. 8 is a perspective view of a sixth embodiment of the subject invention.

FIG. 9 is a view along the line 9—9 in FIG. 8.

FIG. 10 is a perspective view of the embodiment shown in FIG. 11 with the flap up.

FIG. 11 is a perspective view of a seventh embodiment of the subject invention with the flap down.

FIG. 12 is a perspective view of a detail of an eighth embodiment of the subject invention.

DETAILED DESCRIPTION OF THE PREFERRED EMBODIMENTS

FIGS. 1 and 2 show a tennis shoe 10 with a fastening means 12 according to the subject invention in addition to a conventional lace 14. The fastening means 12 comprise a strap 16 and an elastic means 18 for exerting a continous yielding pull on the strap 16. The strap 16 is fixedly attached to the body of the shoe 10 at the end 20 thereof and has a Velcro-type, continuously variable attachment means (hereinafter referred to as a "Velcro attachment means") 22 at the other end. The fastening means 12 bridges an opening 24 in the shoe 10, and the strap 16 is fixedly attached to the body of the shoe 10 on one side of the opening 24. The elastic means 18 comprise a ring 26 sized to receive the strap 16, an elastic member 28 attached to the ring 26, and means 30 for fixedly attaching the elastic member 28 to the body of the shoe 10 on the other side of the opening 24. A Velcro attachment means 32 adapted to co-operate with the Velcro attachment means 22 is mounted on the strap 16 on the same side of the opening 24 as the strap 16 is mounted. In this embodiment, the fastening means 12 is provided to supplement the lace 14 and to provide a safety factor in case the lace 14 breaks during use. Additionally, the bracing action of the fastening means 12 provides a substantial support to the wearer's foot, thereby helping to keep the bones, tendons, ligaments, etc., in their normal position for maximum protection during action sports, and the constant tension provided by the elastic means 18 permits a perpetual natural flexing of the foot, thereby creating a massaging effect to the foot. That is, by having the upper part of the shoe more tautly surrounding the foot than is usually the case and simultaneously permitting the natural flexing of the foot, greater comfort and less foot fatigue is provided.

FIG. 3 shows a tennis shoe 34 similar to the embodiment shown in FIGS. 1 and 2 except that the lace 14 is omitted. In this embodiment, when the wearer's weight is placed on the toe of the shoe, the elastic means 18 permits the opening 24 to widen to accommodate the foot, but then pulls the opening 24 back to its usual dimension when weight is taken off the toe of the shoe. An ordinary laced shoe is incapable of performing this function, and that, in co-operation with the customized fitting offered by the continuously variable, Velcro-type attachment means, is one of the chief advantages of this invention. It should also be noted that, in contrast, to prior-art, laced shoes, this shoe can be fastened using only one hand, and no great dexterity is required to complete the fastening. Children and handicapped persons will benefit greatly from this feature because they will be able to fasten their shoes with minimum effort and dexterity.

FIG. 4 shows a tennis shoe 36 wherein the elastic means 18 comprises an elastic portion of the strap 16 intermediate the Velcro attachments means 32 and the point where the strap 16 is fixedly attached to the body of the shoe 36. Additionally, the shoe comprises a plurality of the fastening means 12 in order to give independent control of the grip of the shoe at a number of different points along the opening 24.

FIGS. 5 and 6 show a tennis shoe 38 wherein the strap 16 is fixedly attached to the inside of the body of the shoe 38 on one side of the opening 24, and an opening 40 sized to receive the strap 16 is formed in the body of the shoe 38 on the other side of the opening 24. The elastic means 18 again comprises an elastic portion of the strap 16 intermediate the Velcro attachment means 22 and the point when the strap 16 is fixedly attached to the shoe 38, and the Velcro attachment means 32 is mounted on the outside of the shoe 38 on the same side of the opening 24 as the strap 16 is mounted.

FIG. 7 shows a shoe 42 wherein the strap 16 is fixedly attached to the outside of the body of the shoe 42 on one side of the opening 24 (which is in the side of the shoe, rather than on top of it), and opening 40 sized to receive the strap 16 is found in the body of the shoe 38 on the other side of the opening 24. This shoe is similar to the shoe of FIGS. 5 and 6 except that the strap 16 passes from the outside of the shoe to the inside through the opening 24 before passing through the opening 40, and two straps 16 are connected to a single tab 44 carrying the Velcro attachment means 22.

FIGS. 8 and 9 show a lady's shoe 46 wherein the fastening means 12 goes around the back of the shoe, the strap 16 is fixedly attached to the body of the shoe 46 on one side of the foot, the elastic means 18 comprises a portion of the strap 16 intermediate the Velcro attachment means 22 and the point where the strap 16 is fixedly attached to the body of the shoe 46, the ring 26 is fixedly attached to the body of the shoe 46 on the other side of the foot, and the Velcro attachment means 32 is mounted on the strap 16 intermediate the Velcro attachment means 22 and the point where the strap 16 is fixedly attached to the body of the shoe 46.

FIGS. 10 and 11 show a dress shoe 48 with a fastening means 12 as previously described and a flap 50 which can be folded down over at least a portion of the strap 16. A Velcro attachment means 52 is provided on the underside of the flap 50, and a co-operating Velcro attachment means 54 is provided on the body of the shoe 48 to hold the flap 50 in place.

FIG. 12 shows a portion of a laced shoe 56 in which at least a portion of the lace 58 is made of an elastic material, a Velcro attachment means 60 is mounted on each end of the lace 58, and a Velcro attachment means 62 is mounted on the shoe body in position to co-operate with the Velcro attachment means 60 at each end of the lace. As will be readily appreciated, this embodiment, though specifically different than the other embodiments, shares the common feature that, when the wearer's weight is placed on the top of the shoe, the elastic means (in this case, the elastic lace 58) permits the opening 24 to widen to accommodate the foot, but then pulls the opening 24 back to its usual dimension when weight is taken off the toe of the shoe. As with the other embodiments disclosed herein, that feature is combined with the customized fitting offered by Velcro attachment means, providing a shoe which can be fitted perfectly to the foot at the outset and which gives unsurpassed comfort to the wearer, particularly during vigorous, quick-action sports such as basketball, tennis, etc.

CAVEAT

While the present invention has been illustrated by detailed descriptions of preferred embodiments thereof, it will be obvious to those skilled in the art that various changes in form and detail can be made therein without departing from the ture scope of the invention. For that reason, the invention must be measured by the claims appended hereto and not by the foregoing preferred embodiments.

What is claimed is:

1. In a shoe of the type having an upper with a variable instep vamp opening and a sole, an improved fastening means comprising:
   (a) an elongated flexible relatively wide single fastening strap having one end permanently secured to the upper adjacent the edge of the vamp opening near the top of the upper,
   (b) one fastening portion of a hook and pile (Velcro-type) fastening material secured to the shoe adjacent the edge of the vamp opening near the top of the shoe and extending downward on the side of the upper toward the sole,
   (c) another and cooperating fastening portion of a hook and pile (Velcro-type) fastening material permanently secured to the free end of the fastening strap on an under side of the strap so as to coact with the fastening material secured to the shoe when the strap is folded transversely of its length and doubled back on its self,
   (d) a ring with an elongated opening to receive the free end of the strap fastening so that the fastening strap may be passed through the ring and double-backed on its self,
   (e) a flexible anchor strap permanently attached to the upper and to the ring for anchoring the ring on the opposite side of the vamp opening from the upper portion carrying the hook and pile fastening material,
   (f) the fastening strap when doubled and secured to the hook and pile fastening material, ring and anchor strap forming a variable and adjustable multiple position linear closure for the variable opening,
   (g) a flexible elastic strap means interposed in the linear closure to allow expansion of the closure as required by use of the shoe.

2. In a shoe as defined in claim 1, the improvement wherein the elastic strap is incorporated in the flexible anchor strap.

3. A shoe as in claim 1 wherein the elastic strap is incorporated in the closure strap.

* * * * *